United States Patent [19]

Flam

[11] 4,319,248

[45] Mar. 9, 1982

[54] INTEGRATED SPIRAL ANTENNA-DETECTOR DEVICE

[75] Inventor: Richard P. Flam, Doylestown, Pa.

[73] Assignee: American Electronic Laboratories, Inc., Colmar, Pa.

[21] Appl. No.: 111,532

[22] Filed: Jan. 14, 1980

[51] Int. Cl.[3] ..... H01Q 1/36

[52] U.S. Cl. ..... 343/701; 343/895; 455/269

[58] Field of Search ..... 343/701, 789, 895; 455/19, 269, 291, 293, 294

[56] References Cited

U.S. PATENT DOCUMENTS

| | | | |
|---|---|---|---|
| 2,943,189 | 6/1960 | Crump | 343/703 |
| 3,098,973 | 7/1963 | Wickersham | 343/701 |
| 3,296,536 | 1/1967 | Copeland et al. | 343/701 |
| 3,441,935 | 4/1969 | Leitner | 343/701 |
| 3,508,269 | 4/1970 | Snyder | 343/701 |
| 3,521,169 | 7/1970 | Turner | 343/701 |
| 3,665,476 | 5/1972 | Taylor | 343/701 |
| 3,707,711 | 12/1972 | Cole et al. | 343/701 |
| 3,789,299 | 1/1974 | Aslan | 343/703 |
| 3,820,118 | 6/1974 | Hall | 343/895 |
| 3,852,755 | 12/1974 | Works et al. | 343/701 |
| 3,925,784 | 12/1975 | Phelan | 343/895 |
| 3,990,081 | 11/1976 | Guennou | 343/786 |
| 4,008,477 | 2/1977 | Babij et al. | 343/701 |
| 4,035,807 | 7/1977 | Tang | 343/742 |
| 4,115,778 | 9/1978 | Snow | 343/701 |
| 4,157,550 | 6/1979 | Reid et al. | 343/786 |

*Primary Examiner*—Eli Lieberman

*Attorney, Agent, or Firm*—Jacob Trachtman

[57] ABSTRACT

An integrated antenna-detector device sensitive over a broadband of frequencies with an extended high frequency limit comprising a pair of antenna elements each having first and second ends, the first ends of the elements being positioned proximate to each other while the second ends are displaced from the first ends, a detector unit positioned and connected between the first ends of the antenna elements, and signal output means connected with the antenna elements at a location displaced from their first ends. The signal output means delivers detected output signals from the antenna elements, and also delivers a biasing signal to the detecting unit. The device may take a number of forms including that of a dipole antenna having a linear or conical configuration, and in which a plurality of such dipole elements are arranged to form a log-periodic antenna, and where the pair of antenna elements are arranged to provide a pair of interwound spiral conductive windings to form a spiral antenna.

8 Claims, 8 Drawing Figures

FIG. 1
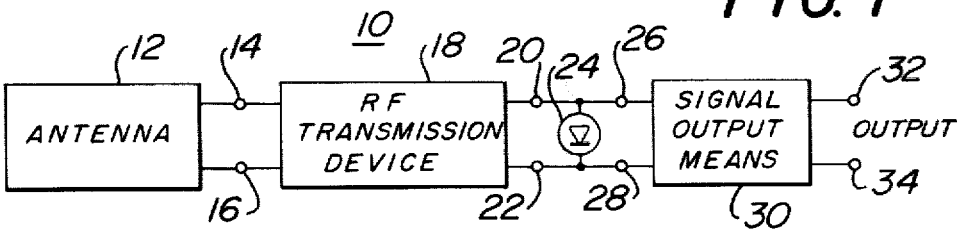
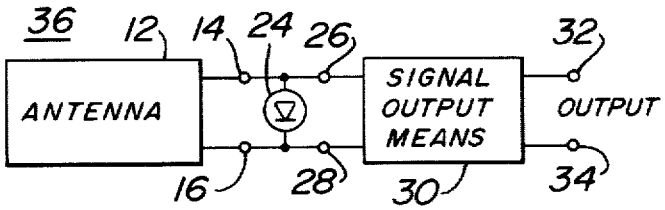
FIG. 2
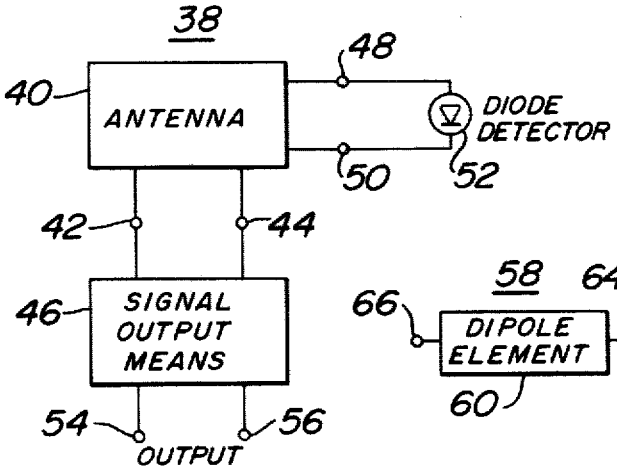
FIG. 3
FIG. 4
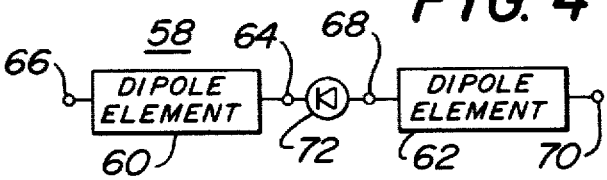
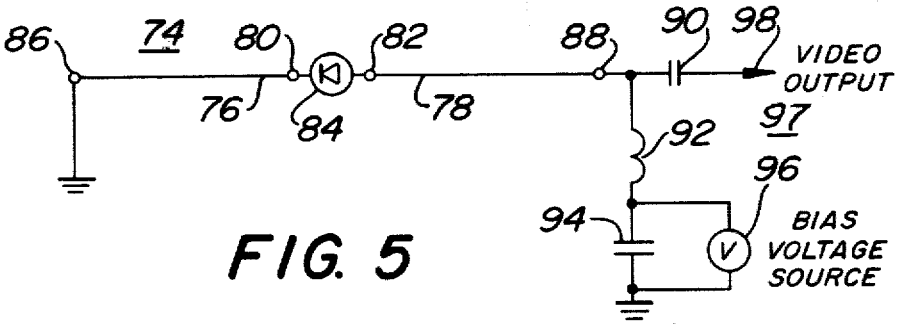
FIG. 5

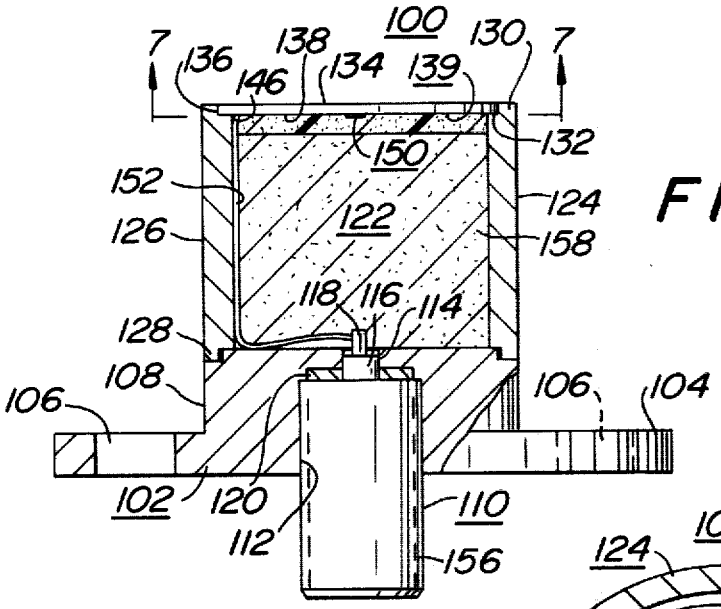
FIG. 6
FIG. 7
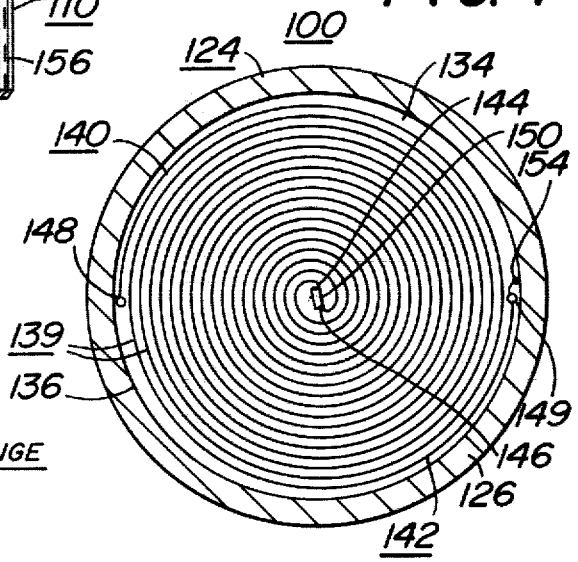
FIG. 8
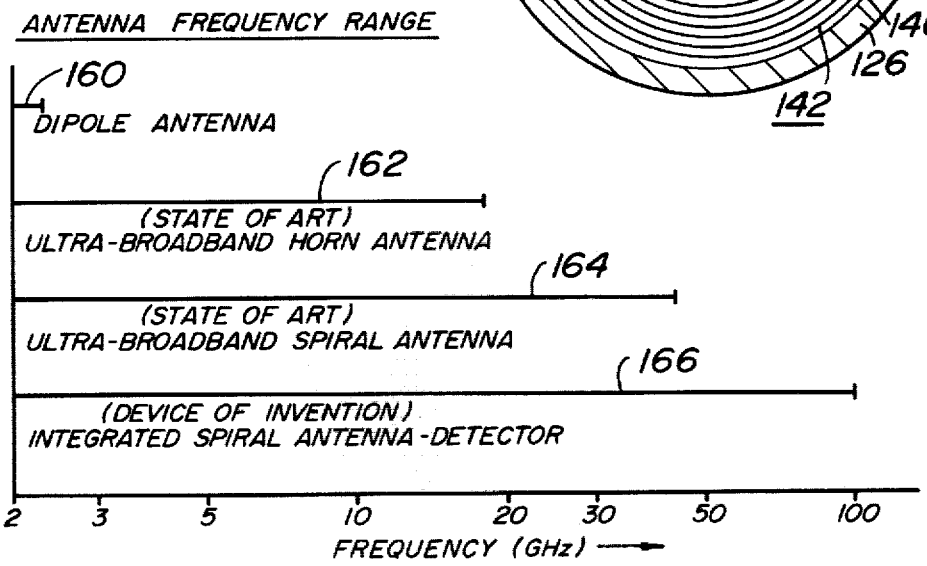

INTEGRATED SPIRAL ANTENNA-DETECTOR DEVICE

The invention relates to an integrated antenna-detector device, and more particularly to an antenna-detector device for receiving and detecting radio frequency signals with a high sensitivity over a broadband of frequencies having with an extended high frequency limit.

Heretofore two element dipole antennas have been provided for receiving and detecting radiated electromagnetic signals. Such antennas have been described as being of the "current radiator" type in which the two elements are characterized as not providing a short circuit at zero frequency (DC). The ability of such an antenna to provide signals of low frequency is limited only by the size of the antenna, while its high frequency limit is a result of the physical and electrical characteristics of the antenna. Conventional dipole antennas with central feed points have been found to be limited by their configuration to an upper frequency of less than 50 GHz. The integration of such an antenna with a detector placed at or near its central feed points avoids loss due to the transmission of radio frequency (RF) signals from the antenna by providing detected signals, but still limits the upper frequency range for signals derived from the antenna. The present invention overcomes such fundamental limitations and raises the frequency limit by a factor of at least 2 when compared to prior art devices.

A principal object of the invention, therefore, is to provide a new and improved integrated antenna-detector device which has a broad frequency range with a greatly extended upper frequency limit for detected radio frequency signals.

Another object of the invention is to provide a new and improved integrated antenna-detector device which is sensitive to radio frequency signals over an extended range of high frequencies for providing detected signals.

Another object of the invention is to provide a new and improved integrated antenna-detector device which is applicable to the "current radiator" type of antennas such as the dipole and spiral antennas for providing a broad frequency range and extended high frequency limit for detected signals.

Another object of the invention is to provide a new and improved integrated antenna-detector device of the "current radiator" type which is effective for providing detected signals for electromagnetic waves in the millimeter wavelength range.

Another object of the invention is to provide a new and improved integrated antenna-detector device providing a cavity backed spiral antenna which is highly sensitive to a broad frequency range of extended high frequencies and has a compact and highly functional configuration.

Another object of the invention is to provide a new and improved integrated antenna-detector device applicable to a log-periodic antenna for providing high sensitivity over a wide frequency band with an extended high frequency limit.

Another object of the invention is to provide a new and improved integrated antenna-detector device which utilizes the output signal means for the device to provide a bias signal for the detector of the device.

Another object of the invention is to provide a new and improved integrated antenna-detector device which directly delivers output signals for transmission by an unbalanced transmission line eliminating the need for a balun.

Another object of the invention is to provide a new and improved integrated antenna-detector device which is simple in construction and highly effective in operation.

The above objects as well as many other objects of and advantages of the invention are achieved by providing an integrated antenna-detector device having a pair of antenna elements each having first and second ends. The first ends of the elements are positioned proximate to each other, while the second ends are displaced from the first ends. A detector unit is positioned and connected between the first ends of the antenna elements, and signal output means are connected with the antenna elements at a location displaced from their first ends. The signal output means delivers detected output signals from the antenna elements, and also delivers a biasing signal to the detector unit. The antenna elements can be configured to provide dipole, spiral and other forms of the "current radiator" type of antennas.

The detector unit may be a "beam-lead" type diode of small configuration positioned between the proximately positioned first ends of the antennas elements, while the signal output means may be connected to the second ends of the antenna elements for delivering detected output signals from the antenna elements and providing a bias signal to the diode from a voltage supply means.

A log-periodic type of antenna is provided by using a plurality of pairs of linear dipole elements which are in parallel spaced relationship to each other and respectively dimensioned for receiving signals of selected frequencies over a band from a low to a high frequency. The pairs of dipole elements have their respective first ends connected to each other by respective signal transmitting lines or conductors, and the detecting unit is positioned and connected between the first ends of the pair of elements dimensioned for the highest frequency of the band. The signal output means is connected with the pairs of elements at a location displaced from the diode and the first ends of the pairs of elements dimensioned for the highest frequency of the band.

In another form, an antenna means is provided by the pair of antenna elements in the form of a pair of interwound spiral conductive windings which have their proximate first ends at the center and their displaced second ends at the periphery of the antenna means. The windings are supported on a flat surface of a plate of a non conductive material. The plate is retained at the top of a body having a conductive cylindrical wall with a cavity therein and encloses the top of the cavity. A base member which is secured at the bottom of the body provides the bottom of the cavity. Signal connecting means is secured with the base member and has a first conductor which extends into the cavity of the body, and a second conductor. An insulated electrical line connects the first conductor of the connecting means with one of the second ends of the pair of windings of the antenna means, and conductive means connect the other second end of the windings of the antenna means with the second conductor of the signal connecting means to provide a cavity backed planar spiral signal receiving and detecting antenna.

The foregoing and other objects of the invention will become more apparent as the following detailed description of the invention is read in conjunction with the drawing, in which:

FIG. 1 is a block diagram of a prior art antenna and detector for radio frequency electromagnetic signals, FIG. 2 is a block diagram of an integrated antenna and detector of the prior art in which the detector is connected across the feed points of the antenna, FIG. 3 is a block diagram of an integrated antenna-detector device of the invention, FIG. 4 is a block diagram of an integrated dipole antenna-detector device of the invention, FIG. 5 is a schematic diagram illustrating a form of an integrated dipole antenna-detector device embodying the invention, FIG. 6 is a sectional view of a cavity backed planar spiral antenna-detector device embodying the invention, FIG. 7 is a sectional view taken on line 7—7 of FIG. 6 , and FIG. 8 is a graph illustrating the range of radio frequency signals detected by a cavity backed planar spiral antenna-detector device of the invention as compared to prior art devices.

Like reference numerals designate like parts throughout the several views.

FIG. 1 is a block diagram of a prior art combination antenna and detector device 10 in which a "current radiator" type antenna 12 has its center feed points 14, 16 connected by a transmission device 18, such as a wave guide or coaxial cable, for transmission of radio frequency signals to its output terminals 20, 22. A signal detector 24 such as a diode, is connected across the output terminals 20, 22 and provides a detected signal to the input terminals 26, 28 of a signal output means 30 which delivers detected video signals to its output terminals 32, 34. The signal output means 30 also delivers a bias signal applied to its terminals 32, 34 to its terminals 26, 28 for application to the detector 24.

In operation the device 10 provides received radio frequency (RF) signals at its feed points 14, 16, which signals are transmitted by the RF transmission device 18 for application to the detector 24. The signals are subject to such loss and distortion which in inherent in the transmission of radio frequency signals by the means 18. The detected signals of the detector 24 are delivered at the output terminals 32, 34 of the means 30. This prior art configuration is insensitive to radio frequency over 50 GHz and fails to provide the broad range and sensitivity required to detect signals in a range above 50 GHz.

FIG. 2 shows in block form a prior art integrated antenna and detector device 36 which is a modified form of the device 10 of FIG. 1. The radio frequency RF transmission device 18 is removed, and the detector 24 is positioned at the feed points 14, 16 of the antenna 12. The detected signal which is of a lower frequency is delivered to the input terminals 26, 28 of the means 30 which may be a coaxial line for its transmission to the output terminals 32, 34. The circuit 36 of FIG. 2 is similar to the circuit 10, except that the RF transmission device 18 is no longer present, so that the transmission loss and distortion of the RF signals are eliminated. The integrated antenna and detector configuration of device 38 also has the fundamental limitations of the device 10, in that signals with frequencies greater than 50 GHZ cannot be detected to provide useful signals at the terminals 32, 34 of the output means 30.

FIG. 3 is a block diagram of an integrated antenna-detector device 38 embodying the invention and having a "current radiator" type antenna 40 provided with a pair of feed points 42, 44 which are connected to a signal output means 46. A distinctly separate pair of connecting points 48, 50 are provided by the antenna 40 across which a detector diode 52 is bridged. In operation, the integrated antenna-detector device 38 provides broadband sensitivity to radio frequency signals with an upper frequency limit which extends greatly beyond 50 GHz, to provide detected signals at the output terminals 54, 56 of the means 46. The terminals 54, 56 also receive a bias signal which is provided to the terminals 42, 44 of the antenna 40 for application across its terminals 48, 50 to the diode 52. The integrated antenna-detector device 38, thus, provides a structural relationship between its components which is fundamentally different from the prior art combination antennas and integrated devices, allowing the detection of received radio frequency signals over a wide band with an extended upper frequency limit.

FIG. 4 is a block diagram of a antenna-detector device 58 embodying the invention, illustrating the application of the invention to a dipole form of antenna comprising a pair of dipole elements 60, 62. The dipole element 60 has a first end 64 and a second displaced end 66, while the other dipole element 62 has a first end 68 positioned proximate to the first end 64 of the dipole element 60, and a second end 70 displaced from the first ends 64, 68 of the dipole elements 60, 62. As is well known, the lower frequency limit of a dipole antenna is limited by the size and configuration of its elements. Thus, for an extended lower frequency range, the length of the dipole elements are increased. The upper or high frequency limit for radio frequency signals received by a dipole antenna, is however, determined by many diverse and complex factors including its mechanical configuration and electrical characteristics provided thereby.

The extended high frequency sensitivity of the invention is provided by obtaining detected output signals from the antenna at locations displaced from the proximately located first ends 64 and 68 of the dipole element 60 and 62. Thus, the detected output signals can be derived at the extremities or ends 66, 70 of the dipole elements 60, 62, or at other locations of the dipole elements which are displaced from the proximately positioned first ends 64, 68. Also of importance for obtaining the high frequency sensitivity of the invention, is the location of the first ends 64, 68 of the dipole elements 60, 62 as close as possible to each other, with a diode detector 72 connected therebetween. Thus, the smaller the configuration of the diode 72, and the closer the inner ends 64, 68 of the elements 60, 62 are positioned to each other, the greater will be the high frequency range and sensitivity. The removal from the region between or proximate to the end points 64, 68, of any connecting points for deriving output signals and delivering bias signals is also responsible for the desirable results achieved by the invention.

In operation, the radio frequency signal received by the dipole element 60, 62 of the device 58 are detected by the diode 72, and the detected output signals are provided at the end 66, 70. A bias signal such as a DC voltage is also delivered across the ends 66, 70 for application through the elements 60, 62 to the diode 72 for obtaining proper biasing for the desired detecting action.

FIG. 5 is a schematic diagram illustrating an integrated dipole antenna-detector device 74 which is a specific form of the device 58 of FIG. 4, applied to a linear dipole form of antenna. The dipole device 74 is provided with dipole elements 76, 78 comprising linear wires which are aligned to provide a pair of proximately positioned ends 80, 82. The ends 80, 82 are closely spaced and joined by a diode 84, preferably of the "beam-lead" type which is in linear alignment with the dipole elements 76 78. The other end 86 of the dipole element 76 is returned to ground potential, while the displaced or outer end 88 of the dipole element 78 is connected to a signal output means 97 comprising a DC blocking capacitor 90 and a line 98 for providing detected or video output signals. The signal output means 97 may also include a choke coil 92 in series with a capacitor 94 connected between the end 88 of the antenna element 78 and ground potential. The junction of the choke coil 92 and the capacitor 94 is connected to the output of a bias voltage source 96 which delivers a DC voltage across the capacitor 94 and through the choke coil 92 to the end 88 of the dipole element 78. The bias voltage is applied through the element 78 to the diode 84 for providing the proper operating conditions for detecting the radio frequency signals, and is returned to ground potential through the dipole element 76 to complete the circuit. The linear dipole antenna-detector device 74, thus, operates to provide detected output signals with respect to ground potential on line 98 of the signal output means 97. Since the output signal is unbalanced, a balun usually needed for providing unbalanced output signals from center fed antenna devices is not required. The bias signals are also fed to the ends 86, 88 of the antenna elements 76, 78 at locations displaced from the proximately positioned ends 80, 82 which are connected to the diode 84. The linear dipole antenna-detector device 74, thus disclosed, has the advantages of the invention, as do other embodiments of the invention which are described hereinafter.

In another embodiment of the invention, a plurality of linear pairs of antenna elements, such as the element 76, 78 of FIG. 5, are arranged as well known in the art in parallel spaced relationship having their corresponding ends 80, 82 interconnected by a respective one of a pair of transmission lines, to comprise an array for providing the advantages of the invention. In order to receive signals over a broadband, the respective pairs of dipole elements are dimensioned for frequencies within the band, with the shortest pair of elements corresponding to the highest frequency of the band, and the longest pair of elements corresponding to the lowest frequency of the received band of radio frequency signals. The detector unit 84 is positioned proximate to and connected between the first ends 80, 82 of the shortest pair of elements 76, 78 which correspond to the high frequency end of the band, while the signal output means is connected with the elements along the transmission lines at a location displaced from the first ends 80, 82 of the shortest pair of elements 76, 78, and preferably proximate to the elements 76, 78 which are dimensioned for the lowest frequency of the band. With this arrangement, the plurality of pairs of antenna elements 76, 78 provide for reception of radio frequency signals and their detection over a wider band of frequencies with an extended high frequency limit, well exceeding the high frequency signals which are detectable by the prior art.

FIGS. 6 and 7 disclose the invention embodied in a cavity backed planar spiral antenna-detector device 100. The device 100 comprises a base member 102 having a mounting flange 104 provided with openings 106 for receiving mounting bolts. The base member 102 has a central cylindrical portion 108 which extends upwardly from the mounting flange 104. A centrally positioned opening 112 extends vertically through the base member and receives the upper end of the cylindrical metal casing 156 of a female coaxial connector 110 through the bottom of the base member 102. The opening 112 in the base member 102 is narrowed at its top 114 for receiving therethrough the upper central portion 116 of the connector 110 and the center conductor wire 118. The wire 118 is electrically insulated from the base member 102 which is made of a metal or conductive material. A metal sealing ring 120 in the opening 112 about the top end 116 of the coaxial connector 110 hermetically seals the end of the connector 110 with the member 102.

The center conductor wire 118 extends beyond the top surface of the cylindrical portion 108 of the base member 102 into a chamber or cavity 122 formed within a body 124 which is also made of a metal or conductive material. The body 124 is cylindrical in form providing a wall 126 of circular cross-section which at its bottom 128 is secured and hermetically sealed with the top of the cylindrical portion 108 of the base member 102 by soldering or any other suitable means for also providing a good electrical connection between the body 124 and the base member 102. The top end 130 of the wall 126 is provided with an internal shoulder 132 which receives and secures within it a thin plate 134 which is made of an electrically insulating material and has a circular periphery 136. The plate 134 encloses the top of the cavity 122 within the body 124 and is secured with the wall 126 to hermetically seal the cavity 122.

The bottom flat surface 138 of the plate 134 bounding the cavity 122 and hermetically sealed therewithin supports a pair of antenna elements 139 (see FIG. 7) respectively comprising spirally interwound conductive windings 140, 142 with respective proximate ends 144, 146 at the center of the plate 134 and respective displaced ends 148, 149 close to the plate's periphery 136. The windings 140, 142 are comprised of elongated highly conductive metal bands which are approximately 0.003 to 0.010 of an inch wide with approximately the same spacing between adjacent bands, and are of equal length. The proximate ends 144, 146 are angularly disposed from each other by 180° about the center of the plate 134, as are the oppositely positioned ends 148, 149 at the periphery 136 of the plate 134.

The spiral windings 139 may be provided on the surface 138 of the plate by the well known technique of plating a thin conductive metal film on the surface 138 and removing portions of the conductive film by etching to form the windings 139 of by other well known means. With the surface 138 positioned within the cavity 122 which is hermetically sealed, the windings are protected from the external environment, as is a detector 150 which is also received within the cavity 122 and connected with the windings 139. The plate 134 with its outer surfce, thus, may be used as a radome for receiving the radio frequency signals therethrough while protecting the antenna windings 139 and the diode 150.

The detector 150, is preferably a "beam-lead" type of diode of miniature configuration with opposite leads in the same plane, and is positioned at the central region of the plate 134 on its bottom surface 138 between the inner ends 144 and 146 of the windings 140, 142. The diode 150 is electrically connected between the inner ends 144, 146 by soldering or other similar suitable means. The outer end 148 of the winding 140 is connected to an end of an electrically insulated wire 152 which extending vertically downward proximate to the inner surface of the wall 126 within the cavity 122 and along the top surface of the cylindrical portion 108 of the base member 102 to the center conductor wire 118 of the connector 110. The center conductor wire 118 is joined to the other end of the wire 152 whereby it is electrically connected to the end 148 of the winding 140 of the pair of antenna elements 139. The other outer end 149 of the winding 142 is electrically joined 154 by welding or other suitable means to the conductive body 124 at its top 130. The end 149 of the winding 142 is thus, electrically connected and returned through the body 124 and base member 102, to the outer cylindrical metal casing 156 of the coaxial connector 110. The cavity 122, prior to sealing and evacuation, is filled with a radiation absorbing material 158 as well known in the art, and a foam spacer is positioned within the cavity 122 between the absorbing material 158 and the bottom surface 138 of the plate 134.

The cavity backed spiral antenna-detector device 100, in practice, provides an extended upper frequency range which can exceed the prior art capabilities by a factor of 2, even with the fundamental limitations provided by the existing components utilized, such as the present day diode detectors, coaxial cables and connectors. With respect to the spiral windings 139, it is noted that their dimensions can be made comparable to that of the minaturized diode 150 such as a beam-lead type of diode having a cross sectional dimension of 0.002 inch to 0.010 inch. As well known, a planar spiral antenna has an operating wavelength determined by $$c=\lambda=\pi d$$

where "c" is circumference and "d" is the diameter of the windings, and $\lambda$ is the corresponding wavelength of the received radio frequency signals. The lower frequency limit is determined by the outermost or largest diameter of the windings 139, while the upper frequency limit is determined by the diameter of the windings 139 at their smallest dimension that still contains a spiral curvature at the center of the plate 134. In the case of the device 100 this curvature has been obtained to a minimum diameter of 0.015 inch, with the diode 150 having a length contained in the 0.015 inch diameter. The antenna device 100 being provided with this mechanical resolution theoretically would provide an extended frequency range up to 250 GHz. However, factors other than the mechanical resolution effectively reduce performance, so that operation has been obtained only up to a region above 100 GHz. The other factors include the thickness of the insulating plate 134 supporting the windings 139 which gives rise to undesirable radiation characteristics, and the internal shunt capacitance of the detector diode 150 which causes a mismatch decreasing sensitivity. Although this shunt capacitance is capable of being tuned out for a narrow band application, for extremely broadband operation it reduces the theoretical upper limit for detecting radio frequency signals.

In operation, the radio frequencies received by the windings 139 of the antenna-detector device 100 are detected by the detector 150 joined to the closely positioned ends 144, 146 of the windings 140, 142. The detected signals are delivered by the wire 152 from the end 148 of the winding 140 to the center conductor wire 118 of the coaxial connector 110 and from the outer end 149 of the winding 142 through the body 124 and base member 102 to the outer conductor of the connector 110. This arrangement allows the delivery of a signal with one side grounded to the coaxial connector for transmission by a coaxial cable which has a grounded outer shell. This avoids the need for a transformer or balun which is required where signals are derived from the center feed points of a balanced antenna for delivery to an unbalanced load or transmission line. The insertion and other losses provided by a balum are thus eliminated, and a detected signal rather than a radio frequency signal can be delivered by a signal output means such as a low loss coaxial cable.

In order to obtain proper operating conditions for the diode detector 150, a bias voltage is also delivered from a voltage source as by the coaxial cable (not shown) joined to the connector 110. The bias voltage on the center conductor wire 118 of the connector 110 is delivered through the insulated wire 152 to the outside end 148 of the winding 140 to one side of the diode 150. The bias applied to the diode 150 is returned at its other side through the winding 142 to its outer end 149 and the body 124 and base member 102 to the outer metal casing 156 of the connector 110. The antenna-detector device 100, thus, achieves the advantages of the invention by receiving and detecting a broadband of radio frequency signal having an extended high frequency range unattainable by prior art devices of the character described. The device 100, also provides a compact configuration which is highly durable and reliable in operation.

FIG. 8 is a graph illustrating the range of radio frequency signals detected by an integrated antenna-detector device of the invention as compared to prior art devices. In the graph of FIG. 8, the lower frequency limit for the devices illustrated was chosen to be 2 GHz ($2\times10^9$ HZ) to allow a direct comparison of the bandwidths and highest frequency limits of the devices. The frequency is shown along a logrithmic scale ranging between 2 to 200 GHz. The horizontal bar 160 of the graph illustrates the bandwidth of a prior art center fed conventional dipole antenna which extends from 2 to 2.4 GHz and has a very narrow band especially when compared with the horizontal bar 162 representing the frequency range of an ultra-broad band horn antenna. The ultra-broad band horn antenna has a broad frequency range of 2 to 18 GHz representing the state of the art and is provided by AEL Model H1498 manufactured by American Electronic Laboratories, Inc. A state of the art ultra-broad band spiral antenna is represented by the horizontal bar 164 and has an extended frequency range of 2 to 40 GHz. Such a device is embodied in AEL Model ASM1601A also manufactured by American Electronic Laboratories, Inc.

The horizontal bar 166 of graph 8, represents an integrated spiral antenna-detector device of the invention, such as that described in connection with the device 100 of FIGS. 6 and 7. The device has provided a detected output signal for radio frequencies over a range of 2 to 100 GHZ, well exceeding the capabilities of all of the other prior art devices illustrated. The upper range of the device 100, as previously noted, is limited by the physical and electrical parameters of the components and materials available at the present time, and on a theoretical basis should extended well beyond the present limit to an upper frequency of 250 GHz.

It will be obvious to those skilled in the art that additional modifications and variations of the disclosed broadband frequency-detector antennas will be readily apparent to those skilled in the art, and that the invention may find wide application with appropriate modification to meet the particular design circumstances, but without substantially departing from the essence of the invention.

What is claimed is:

1. An integrated antenna-detector device comprising a pair of antenna elements providing a spiral antenna means for receiving radio frequency signals over a broadband of frequencies with an extended high frequency limit, the elements each having first and second ends and providing a pair of interwound conductive windings with their first ends positioned proximate to each other at the center of the antenna means for providing sensitivity at the high frequency limit of received radio frequency signals and having their second ends displaced from the first ends and positioned at the periphery of the antenna means, a detector unit connected between the positioned proximate to the first ends of the antenna elements for detecting radio frequency signal received by the antenna elements and providing detected video output signals, and signal output means connected with the antenna elements at a location substantially displaced from the detector unit and the first ends of the antenna elements for receiving the detected video output signals.

2. The device of claim 1 in which the signal output means delivers detected output signals from location proximate to the second ends of the antenna elements.

3. The device of claim 2 in which the signal output means delivers a biasing signal to the detector unit through the antenna elements.

4. The device of claim 3 which includes a flat plate of non conductive material supporting on a flat surface thereof the conductive windings of the spiral antenna means.

5. The device of claim 4 which includes a supporting body with a conductive cylindrical wall providing a cavity therein, the plate has a circular periphery and is supported at the top of the body enclosing the top of its cavity, a base member at the bottom of the body encloses the bottom of its cavity, and the signal output means includes signal connecting means secured with the base member and having a first conductor which extends into the cavity of the body and a second conductor, an insulated electrical line connecting the center conductor of the connecting means with one of the second ends of the pair of windings of the antenna means, and conductive means connecting the other second end of the windings of the antenna means with the second conductor of the connecting means.

6. The device of claim 5 in which the signal output means delivers a biasing signal to the detector unit through the windings of the antenna means.

7. The device of claim 6 in which the detecting unit is a beam-lead diode and the signal connecting means is a coaxial connector with a center wire conductor which extends into the cavity of the body and an outer cylindrical conductor which is electrically connected through the base and body to the other second end of the windings of the antenna means.

8. The device of claim 7 in which the cavity of the body is hermetically sealed and contains a radiation absorbing material and the windings of the antenna means and detector unit are on an internal surface of the plate enclosing the cavity of the body, the device providing a cavity backed planar spiral signal receiving and detecting antenna.

* * * * *